US007222953B2

(12) United States Patent
Yokoyama

(10) Patent No.: US 7,222,953 B2
(45) Date of Patent: May 29, 2007

(54) INK JET RECORDING APPARATUS USING A TEMPERATURE DETECTOR TO CONTROL THE CURING OF INK

(75) Inventor: Takeshi Yokoyama, Machida (JP)

(73) Assignee: Konica Minolta Medical & Graphic, Inc., Tokyo (JP)

( * ) Notice: Subject to any disclaimer, the term of this patent is extended or adjusted under 35 U.S.C. 154(b) by 335 days.

(21) Appl. No.: 10/942,238

(22) Filed: Sep. 16, 2004

(65) Prior Publication Data

US 2005/0068361 A1 Mar. 31, 2005

(30) Foreign Application Priority Data

Sep. 29, 2003 (JP) ..... 2003-338621

(51) Int. Cl.
*B41J 2/01* (2006.01)
*B41J 29/377* (2006.01)

(52) U.S. Cl. ..... 347/102; 347/18
(58) Field of Classification Search ..... 347/102
See application file for complete search history.

(56) References Cited

U.S. PATENT DOCUMENTS 5,231,423 A * 7/1993 Wataya et al. ..... 347/18
6,145,979 A 11/2000 Caiger et al.
2002/0139004 A1* 10/2002 Laudat et al. ..... 34/60
2003/0231234 A1* 12/2003 Ushirogouchi et al. ..... 347/100

FOREIGN PATENT DOCUMENTS

JP 60-132767 A 7/1985

* cited by examiner

*Primary Examiner*—Stephen Meier
*Assistant Examiner*—Jannelle M. Lebron
(74) *Attorney, Agent, or Firm*—Frishauf, Holtz, Goodman & Chick, P.C.

(57) ABSTRACT

An ink jet recording apparatus having a recording head that jets photo-hardening ink which is hardened when it is exposed to ultraviolet rays on a recording medium, a radiation apparatus equipped with a light source that radiates ultraviolet rays to jetted ink, a cooling device that cools the radiation apparatus, a temperature detector that detects a temperature of the radiation apparatus and a controller that controls temperature of the cooling device depending on the temperature detected by the temperature detector.

15 Claims, 4 Drawing Sheets

FIG. 2 ( a )
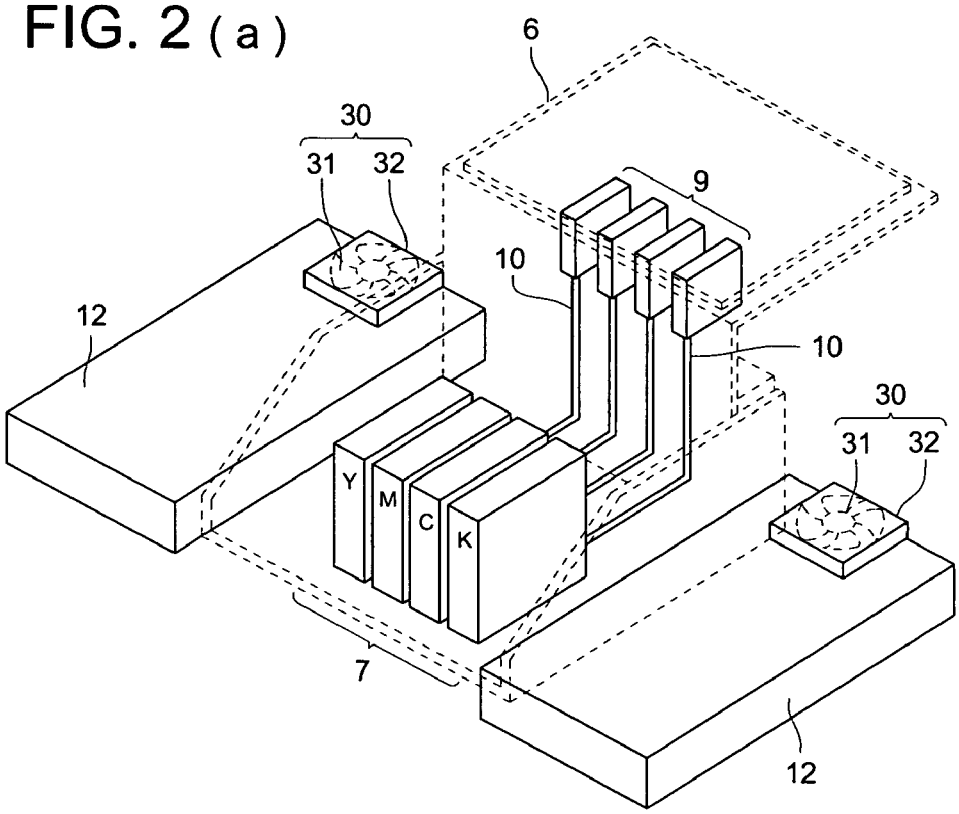
FIG. 2 ( b )
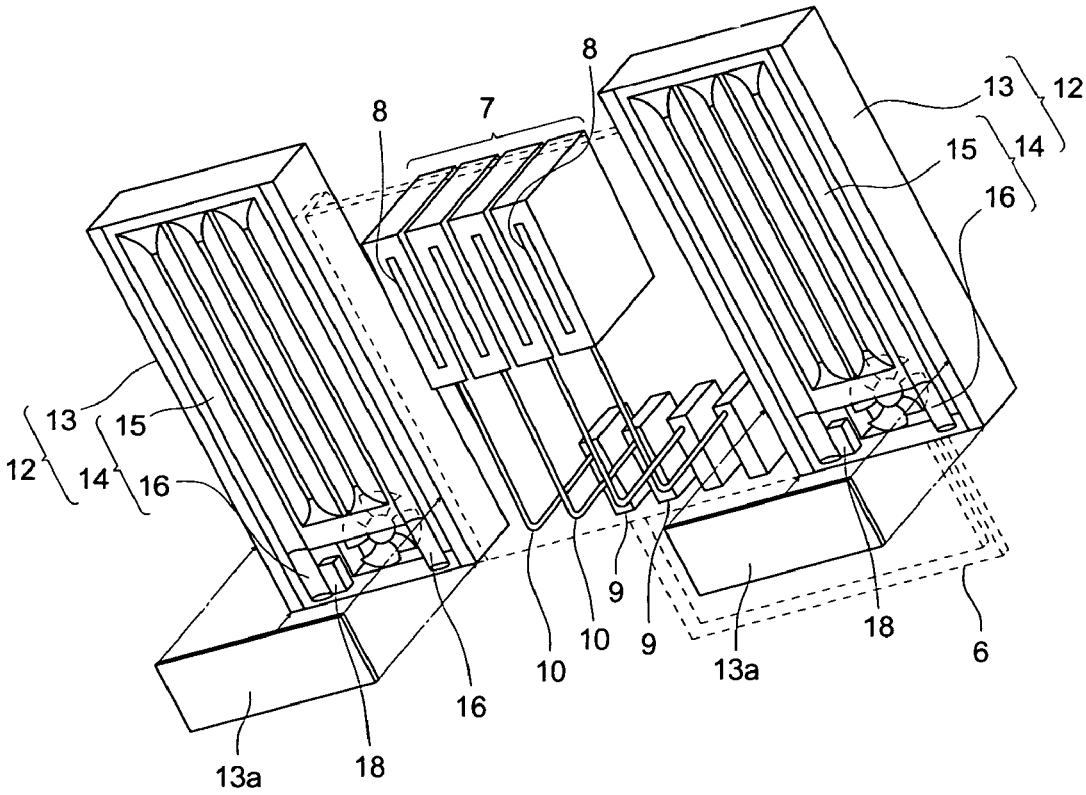

INK JET RECORDING APPARATUS USING A TEMPERATURE DETECTOR TO CONTROL THE CURING OF INK

BACKGROUND OF THE INVENTION

The present invention relates to an ink jet recording apparatus, and in particular, to an ink jet recording apparatus that conducts image recording by employing photo-hardening ink that is hardened by being exposed to light.

As a method for forming images even on a base material having poor ink absorbing properties, there is known a UV ink jet recording method. In general, UV-hardening ink containing therein a photoinitiator having sensitivity to ultraviolet rays is used, and the ink impacted is exposed to ultraviolet rays. In the case of this method, an expansion of a dot diameter, ink blotting between dots and ink penetration to the base material take place until the moment when the ink is hardened by ultraviolet rays and fixed, resulting in changes of image quality.

In the UV ink jet recording method described above, factors influencing greatly on image quality in particular include sensitivity of ink, a period of time up to the exposure to light and a wavelength and intensity of a ray of light. It is preferable to shorten, to the utmost, a period of time from ink jetting to exposure to light, because problems of dot diameters and blotting become conspicuous as time passes after an ink impact.

Japanese TOKKAISHO No. 60-132767 and U.S. Pat. No. 6,145,979 disclose an ink jet recording apparatus wherein a light source is arranged immediately abreast with an ink jet head so that a period of time from ink jetting to exposure to light may be shortened.

However, rays such as ultraviolet rays radiated from a radiation apparatus sometimes adversely affect on human bodies. Therefore, for using safely an ink jet recording apparatus equipped with the radiation apparatus radiating such rays, it is necessary to provide a cover so that rays radiated from the radiation apparatus may not leak out. However, if the radiation apparatus is arranged in the space surrounded by the cover, heat generated from the light source is not radiated, and temperatures in the vicinity of the light source are raised.

Conventional light sources for ultraviolet rays include those of a type of high power and high output such as a high-pressure mercury vapor lamp and a metal halide lamp, and temperatures of heat generated from them are as high as 650–900° C., and the above-mentioned tendency was especially conspicuous.

In recent years, therefore, there is proposed to use a light source for ultraviolet rays of a type of low power and low output such as a low-pressure mercury vapor lamp and a cold-cathode tube wherein temperatures of heat generated are controlled to be as low as 70–130° C. This low output type can be used for hardening ink of a cation hardening type that is of an energy accumulating type hardened by light exposure for a long time despite low illumination intensity.

However, the luminous efficiency for the low output type has a property to depend on the temperature at metal cap of a light source that conducts discharging, resulting in a problem that it is difficult to maintain an appropriate luminous efficiency for ink hardening stably.

SUMMARY OF THE INVENTION

An object of the invention is to stabilize the luminous efficiency of a light source for ultraviolet rays with low output, and thereby to conduct image forming.

The object stated above can be attained by any one of ink jet recording apparatuses shown in the following Structures (1)–(11).

Structure (1): An ink jet recording apparatus having the structure including therein a recording head that jets photo-hardening ink which is hardened when it is exposed to ultraviolet rays on a recording medium, a radiation apparatus equipped with a light source that radiates ultraviolet rays to jetted ink, a cooling device that cools the radiation apparatus, a temperature detection means that detects a temperature of the radiation apparatus and a control means that conducts temperature control for the cooling device depending on the temperature detected by the temperature detection means.

In the Structure (1) mentioned above, the recording head jets ink on a recording medium in the case of image forming, and this jetted ink is exposed to ultraviolet (UV) rays by the radiation apparatus to be hardened and fixed on the recording medium.

Then, the temperature detection means conducts temperature detection for the radiation apparatus, and the control means controls the cooling device so that the radiation apparatus may be maintained at the prescribed temperature, or it may be within a range of prescribed temperatures.

In this case, for controlling leakage of ultraviolet rays by providing a cover, it is preferable to use those of a type of low power and low output such as a low-pressure mercury lamp, a black light, a cold cathode ray tube or light emission diode (LED), as a light source for ultraviolet rays, and a decline of the luminous efficiency which easily takes place in such light source can be controlled by maintenance of temperatures.

Structure (2): The ink jet recording apparatus having the same structure as that in Structure (1) wherein the temperature detection means detects a temperature at metal cap of the light source.

In the case of using a low power and low output light source for ultraviolet rays, changes of its temperature, especially changes of temperatures at metal cap tend to influence on the luminous efficiency, and the luminous efficiency can be stabilized by detecting the temperature of the metal cap and by controlling the cooling device based on the detection of the temperature at metal cap.

Structure (3): The ink jet recording apparatus having the same structure as that in Structure (1) or Structure (2) wherein the control means controls the cooling device so that the detected temperature at metal cap of the light source may be within a range of 35° C. to 65° C.

When the low power and low output light source for ultraviolet rays is used, it is desirable to keep its luminous efficiency to be at the maximum, because its output is low. For example, when a low-pressure mercury lamp is used as a low power and low output light source for ultraviolet rays, its luminous efficiency depends on the temperature at a metal cap. Though the temperature at a metal cap that makes the luminous efficiency to be at the maximum varies depending on a lamp tube, a structure of the metal cap and electric power to be applied, it is preferable to control the temperature at a metal cap to be in a range of 35–65° C. Therefore, when the low power and low output light source for ultraviolet rays is used in the aforementioned structure, images are formed under the condition that the highest luminous efficiency is kept.

Structure (4) is provided with the structure which is the same as that of the invention in any one of Structures (1)–(3), and has a construction in which the control means controls the cooling device so that the metal cap may be at the temperature that makes the radiation intensity for ultraviolet rays to be at the maximum with a tolerance of ±5° C.

When a low-pressure mercury lamp is used as a low power and low output light source for ultraviolet rays, though the temperature at a metal cap that makes the luminous efficiency to be at the maximum varies depending on a lamp tube, a structure of the metal cap and electric power to be applied, images can be formed under the condition that the luminous efficiency is kept to be highest, by controlling the temperature at the metal cap to be within a tolerance of ±5° C. for the temperature at the metal cap that makes the luminous efficiency to be at the maximum.

Structure (5): An ink jet recording apparatus having the structure including therein a recording head that jets photo-hardening ink which is hardened when it is exposed to ultraviolet rays on a recording medium, a radiation apparatus equipped with a light source that radiates ultraviolet rays to jetted ink, a cooling device that cools the radiation apparatus by supplying the open air, a temperature detection means that detects a temperature of the open air and a control means that stores information about relationship between the open air temperature and an output of the cooling device for maintaining a temperature of the light source to be a prescribed temperature, and conducts temperature control for the cooling device depending on the temperature detected by the temperature detection means, by referring to the aforementioned information.

In the Structure (4) mentioned above, the recording head jets ink on a recording medium in the case of image forming, and this jetted ink is exposed to ultraviolet rays by the radiation apparatus to be hardened and fixed on the recording medium.

Then, the control means determines, referring to information about relationship between the open air temperature and an output of the cooling device, an output of the cooling device for making the light source temperature to be constant, based on the open air temperature detected by the temperature detection means.

In this case, for controlling leakage of ultraviolet rays by providing a cover, it is preferable to use those of a type of low power and low output such as a low-pressure mercury lamp, a black light, a cold cathode ray tube or LED, as a light source for ultraviolet rays, and a decline of the luminous efficiency which easily takes place in such light source can be controlled by maintenance of temperatures.

Structure (6): An ink jet recording apparatus having the structure including therein a recording head that jets photo-hardening ink which is hardened when it is exposed to ultraviolet rays on a recording medium, a radiation apparatus equipped with a light source that radiates ultraviolet rays to jetted ink, a cooling device that cools the radiation apparatus, a light intensity detection means that detects the intensity of irradiation light coming from the radiation apparatus and a control means that controls temperatures of the cooling device depending on the light intensity detected by the light intensity detection means.

In the Structure (6) mentioned above, the recording head jets ink on a recording medium in the case of image forming, and this jetted ink is exposed to ultraviolet rays by the radiation apparatus to be hardened and fixed on the recording medium.

As a light source for the radiation means, the one of a type of low power and low output depends on temperatures for its luminous efficiency. In particular, if temperature rise takes place in the state of the best efficiency, that luminous efficiency tends to decline. With the foregoing as an assumption, therefore, the light intensity detection means conducts light intensity detection for irradiation light coming from the radiation apparatus, in the course of image forming, while, the control means controls an output of the cooling device so that the light intensity may be raised again, when the light intensity of irradiation light coming from the radiation apparatus is lowered.

Structure (7): The ink jet recording apparatus having the same structure as that in Structure (1), (2), (3), (4), (5) or (6) wherein the radiation apparatus is equipped with a cover that veils the light source, the cooling device is an air cooling apparatus that supplies the open air into the cover, and an exhaust port is provided on the cover.

In the above-mentioned structure, the open air is supplied by the cooling device into the cover of the light source, and the air is exhausted through the exhausted port to cool the light source.

Structure (8): The ink jet recording apparatus having the same structure as that in Structure (7), wherein the exhaust port is formed to be open in the direction other than the direction in which the recording head faces a recording medium on which the recording head jets ink.

In the above-mentioned structure, air is exhausted from the inside of the cover in the direction other than that towards the recording medium on which ink is jetted, thus, an influence of exhaustion of cooling air in image forming can be avoided.

Structure (9): The ink jet recording apparatus having the same structure as that in Structure (8), wherein there is provided a carriage mechanism that carries the recording head in the prescribed direction, and the exhaust port is formed to be open in the direction perpendicular to the conveyance direction for the recording head.

In the above-mentioned structure, air is exhausted from the inside of the cover in the direction which is other than that towards the recording medium on which ink is jetted and is perpendicular to the conveyance direction for the recording head, thus, an influence of exhaustion of cooling air in image forming can be avoided. It is further possible to avoid an influence on conveyance of the recording head in the carriage.

Structure (10): The ink jet recording apparatus having the same structure as that in any one of Structures (1)–(9), wherein the light source is any one of a low-pressure mercury lamp, a black light, a cold-cathode tube or LED.

Owing to the above-mentioned structure, ink is hardened and fixed by a light source for ultraviolet rays of a type of low power and low output of any one of a low-pressure mercury lamp, a black light, a cold-cathode tube and LED.

Structure (11): The ink jet recording apparatus having the same structure as that in any one of Structures (1)–(10), wherein ink is cation-polymerization-based ink containing cation-polymerization-based compound.

Owing to the above-mentioned structure, ink is hardened properly by a light source for ultraviolet rays of a type of low power and low output.

In the ink jet recording apparatus shown in the Structure (1), the control means controls the cooling device for the radiation apparatus based on the detected temperature of the radiation apparatus, and therefore, even when using a light source for ultraviolet rays of a type of low power and low output whose luminous efficiency is easily changed by temperature changes, it is possible to stabilize its luminous efficiency to be within a certain range, to attain stable hardening of ink and to attain stabilization of image quality.

In the ink jet recording apparatus shown in the Structure (2), the control means controls the cooling device based on the detected temperature at metal cap of the light source, and therefore, it is possible to stabilize the luminous efficiency of the light source, to attain stable hardening of ink and to attain stabilization of image quality, for the light source for ultraviolet rays of a type of low power and low output whose luminous efficiency is easily changed especially by changes of temperature at metal cap.

In the ink jet recording apparatus shown in the Structure (3), the cooling device is controlled so that the temperature of the light source may be within a range of 40±5° C., and therefore, when using a low-pressure mercury lamp representing the light source for ultraviolet rays of a type of low power and low output, it is possible to maintain its luminous efficiency to be the maximum, to attain quick hardening of ink at the highest luminous efficiency and thereby to stabilize image quality.

In the ink jet recording apparatus shown in the Structure (5), the control means controls the cooling device that maintains the radiation apparatus at a certain temperature based on the detected temperature of the open air, and therefore, even when using the light source for ultraviolet rays of a type of low power and low output whose luminous efficiency is easily changed by temperature changes, it is possible to stabilize its luminous efficiency to be within a certain range, to attain stabilized ink hardening and to attain stabilized image quality.

In the ink jet recording apparatus shown in the Structure (6), the control means controls an output of the cooling device of the radiation apparatus based on the detected intensity of the radiation apparatus, and therefore, even when using the light source for ultraviolet rays of a type of low power and low output whose luminous efficiency is easily changed by temperature changes, it is possible to recognize, based on the change in the detected light intensity, that the temperature of the light source has been changed, and thereby to stabilize its luminous efficiency to be within a certain range, then, to attain ink hardening stably and to attain stabilization of image quality.

In the ink jet recording apparatus shown in the Structure (7), the cover provided on the light source prevents more ultraviolet rays than needed from leaking out, which makes it possible control an influence that is harmful to the outside. Further, the cooling device sucks air in and exhaust air out of the inside of the cover, which makes it possible to control a temperature of the light source properly.

In the ink jet recording apparatus shown in the Structure (8), the exhaust port that exhausts air from the inside of the cover faces in the direction other than the direction towards a recording medium onto which ink is jetted, thus, the recording medium is not exposed to cooling exhausted air, and an influence of cooling exhausted air in the course of image forming can be prevented.

In the ink jet recording apparatus shown in the Structure (9), the exhaust port through which air is exhausted from the inside of the cover is in the direction which is different from the direction towards a recording medium onto which ink is jetted and is perpendicular to the conveyance direction for the recording head, thus, an influence of exhaustion of cooling air in the course of image forming and an influence of exhaustion of cooling air in conveyance of the recording head can be prevented.

In the ink jet recording apparatus shown in the Structure (10), a light source for ultraviolet rays of a type of low power and low output of any one of a low-pressure mercury lamp, a black light, a cold-cathode tube and LED is used, and thereby, the state of excessive high temperature can be avoided, even when the cover is provided.

In the ink jet recording apparatus shown in the Structure (11), ink is cation-polymerization-based ink containing cation-polymerization-based compound, ink can be hardened and fixed properly even when a light source for ultraviolet rays of a type of low power and low output is used.

Further, the cation-polymerization-based ink can be hardened in a short period of time because its polymerization reaction is hardly impeded by oxygen in the air. Therefore, it is not necessary to provide a large-sized light source, and downsizing, weight reduction and cost reduction of the apparatus can be attained, which is an effect of the invention.

BRIEF DESCRIPTION OF THE DRAWINGS

FIG. 2(*a*) is a perspective view showing a carriage provided on the ink jet recording apparatus shown in FIG. 1 and a UV radiation apparatus. FIG. 2(*b*) is a bottom face view for the carriage of the ink jet recording apparatus shown in FIG. 2(*a*) and for the UV radiation apparatus.

DETAILED DESCRIPTION OF THE PREFERRED EMBODIMENT

Figure 1:
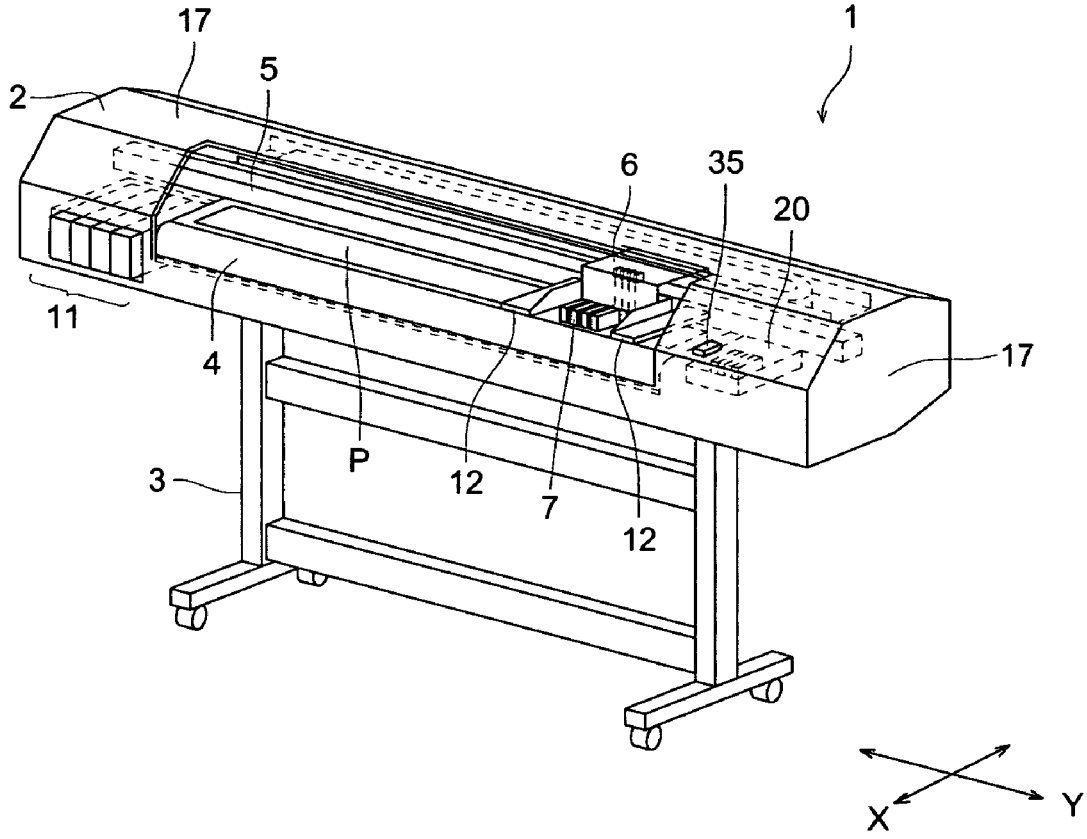
FIG. 1 is a perspective view showing the structure of primary portions of an embodiment of the ink jet recording apparatus of the invention.

An embodiment of the invention will be explained as follows, referring to the drawings attached.

As shown in FIG. 1 in the present embodiment, ink jet recording apparatus 1 is one of a serial print system which is equipped with printer main body 2 and supporting stand 3 that supports a bottom of the printer main body 2. On the central portion of the printer main body 2, there is arranged platen 4 that supports non-recording surface of recording medium P and extends in the longitudinal direction of the printer main body 2, so that the recording medium P may be conveyed by an unillustrated conveying mechanism on the platen 4 in conveyance direction X.

Bar-shaped guide rail 5 extending in the longitudinal direction of the printer main body 2 is provided on the upstream side in the conveyance direction X for the recording medium P above the platen 4. Carriage 6 is supported on the guide rail 5, and the carriage 6 is driven by an unillustrated driving mechanism to move freely along the guide rail 5 in main scanning direction Y on a reciprocating basis.

As shown in FIG. 1, FIG. 2(*a*) and FIG. 2(*b*), a group of four recording heads 7 corresponding to respective colors (yellow (Y), magenta (M), cyan (C) and black (K)) used in the ink jet recording apparatus 1 in the present embodiment is mounted on the carriage 6. Each of the recording heads 7 is formed to be in a shape of a rectangular parallelepiped substantially, in terms of an external form, and respective recording heads are arranged side by side so that the longitudinal direction of each of them may be in parallel with others, and on surfaces of the recording heads 7 each facing recording medium P, there are provided ink jetting ports 8 and each of recording heads 7 jets ink from each of ink jetting ports 8. Incidentally, ink used in the ink jet recording apparatus is not limited to this, and for example, colors of light yellow (LY), light magenta (LM) and light cyan (LC) may also be used. In this case, recording heads corresponding to respective colors are mounted on the carriage.

On the carriage 6, there are provided intermediate tanks 9 in quantity corresponding to the number of recording heads 7 each intermediate tank supplying ink to each of recording heads 7, and each recording head 7 is communicated with each intermediate tank 9 through each ink supply tube 10. Incidentally, each intermediate tank 9 is communicated with each ink tank 11 provided at one end of the movement range for the carriage 6 outside the platen 4, through an unillustrated ink supply path, so that ink may be supplied to recording heads 7 from ink tanks 11 through intermediate tanks 9 at any time.

Radiation apparatuses 12 each serving as a light radiation apparatus are provided on both sides of the carriage 6 to be in contact with both flanks of the carriage 6. Each radiation apparatuses 12 is equipped with light source cover 13 that is formed to be in a form of a box having an opening on its one end, and is arranged so that the opening on the light source cover 13 may face a recording surface of the recording medium P. Further, inside the light source cover 13, there are provided low-pressure mercury lamps 14 each representing a light source that radiates ultraviolet rays which harden and fix UV-hardening ink impacted on recording medium P. In addition, on a part of the opening on the cover 13, there is arranged bottom plate 13*a* so that it may cover metal cap 16 of low-pressure mercury lamps 14 which will be described later.

As shown in FIG. 2(*b*), each of low-pressure mercury lamps 14 is composed of bent light-emitting tube 15 and metal caps 16 attached on both ends of the light-emitting tube 15, wherein light is emitted when the metal caps 16 are energized. Incidentally, a shape of the light-emitting tube 15 in each low-pressure mercury lamp 14 is not limited to those shown in FIG. 2(*b*), and for example, the one having the structure wherein metal caps are attached on both ends of a U-shaped light-emitting tube may also be used.

Figure 4:
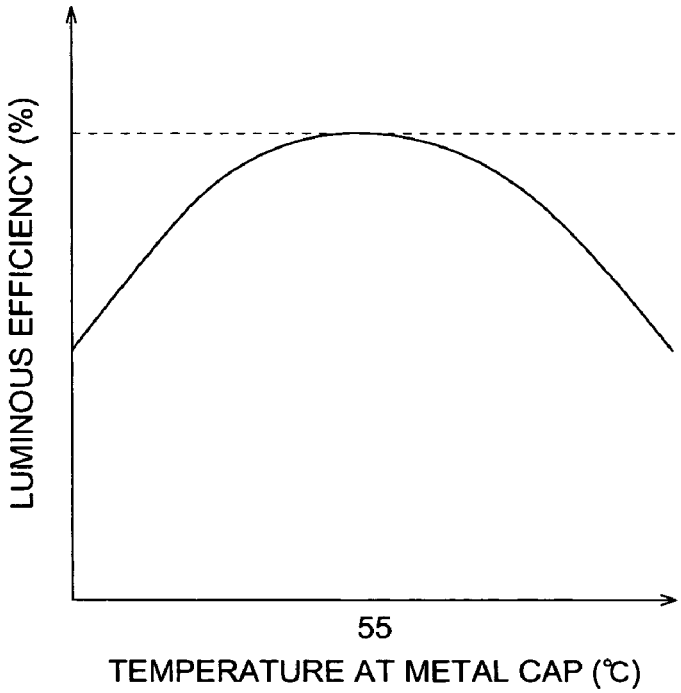
FIG. 4 is a diagram showing relationship between a temperature at metal cap and luminous efficiency.

Each of the low-pressure mercury lamps 14 has characteristics that UV generating energy varies to cause a difference depending on temperatures of metal caps 16. FIG. 4 is a diagram showing relationship between a temperature at metal cap 16 and luminous efficiency. As is shown in FIG. 4, in the lamp of the present invention, a mercury vapor pressure of each low-pressure mercury lamp 14 is 0.8 Pa when the temperature of each metal cap 16 is about 55° C., resulting in the best UV luminous efficiency.

Printer main body 2 is covered by cover 17 so that a total range of movement of the platen 4 and the carriage 6 may be isolated from the outside, thus, the cover 17 and the light source cover 13 prevent light emitted from the radiation apparatuses 12 from leaking out.

Figure 3:
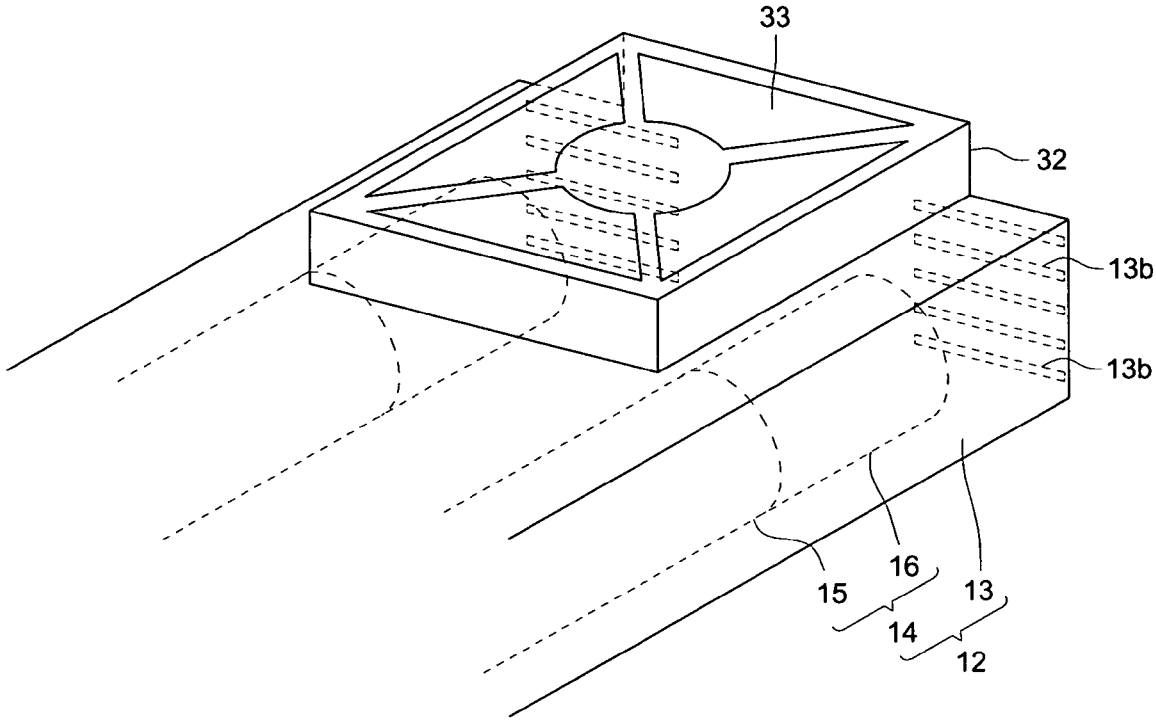
FIG. 3 is an enlarged perspective view showing the peripheral structure of a cooling device.

On the top (opposite to the surface where an opening is formed) of each light source cover 13, there is provided cooling device 30 of an air cooling type. The cooling device 30 is equipped with air cooling blower 31 and with casing 32 that houses an unillustrated drive motor for the air cooling blower 31 and the air cooling blower 31. As shown in FIG. 3, slit-shaped air intakes 13*b* are provided on one end of the light source cover 13, and exhaust port 33 is provided on the casing 32. When the air cooling blower 31 is driven to rotate, the open air is taken into the light source cover 13 through the air intakes 13*b*, and is ejected from the exhaust port 33 through the light source cover 13 and the inside of the casing 32.

The air intakes 13*b* are provided in the vicinity of metal caps 16 which are positioned respectively at both ends of the low-pressure mercury lamp 14, and thereby, the open air taken in hits each metal cap 16 quickly, resulting in excellent cooling.

Since the exhaust port 33 is opened in the direction that is perpendicular to the direction of movement of carriage 6 and is opposite to that of platen 4, exhausted air is not blown out to the recording medium side in the course of image forming so that no influence may be exerted on image forming.

Further, as shown in FIG. 2(*b*), temperature sensor 18 representing a temperature detection means is provided at the metal cap 16 of the low-pressure mercury lamp 14 to detect temperatures of the metal cap 16.

In addition, maintenance unit 20 that conducts maintenance work for recording heads 7 is arranged at the position that is the other end of a range of movement of the carriage 6 and is opposite to the ink tanks 11 with the platen 4 between.

The ink used in the present embodiment is photo-hardening ink having properties to be hardened when it is exposed to ultraviolet rays representing light, and it contains at least polymerization-based compound (including known polymerization-based compounds), a photoinitiator and a coloring material, as the principal ingredients. Though the photo-hardening ink is divided broadly into radical-polymerization-based ink containing radical-polymerization-based compound as a polymerization-based compound and cation-polymerization-based ink containing cation-polymerization-based compound, cation-polymerization-based and UV-hardening ink whose hardening reaction varies depending on humidity and temperature is especially used in the present embodiment. The cation-polymerization-based ink used in the present embodiment is a mixture containing at least cation-polymerization-based compounds such as oxetane compounds, epoxy compounds and vinyl ether compounds, photo-cation-initiator and coloring materials.

Next, as recording medium P used in the present embodiment, various types of sheets including plain paper, recycled paper and glossy paper applied to ordinary ink jet recording apparatuses and recording media made of various types of cloth, various types of non-woven fabrics, resins, metals and glasses can be used. Forms of the recording medium P capable of being used include a roll shape, a cut sheet shape and a sheet shape.

The ink jet recording apparatus 1 is further equipped with an unillustrated control means for the cooling device 30. This control means is equipped with a control section for a speed of revolution of a drive motor for air cooling blower 31 of the cooling device 30 and with a temperature calculating section that calculates a temperature of metal cap 16 based on signals detected by temperature sensor 18 that is provided at the metal cap 16 of each low-pressure mercury lamp 14.

Further, the control means constantly judges whether the calculated temperature is within a range of 55±5° C. or not, in the course of image forming. When the temperature range stated above is exceeded, the control means increases the number of rotations of the drive motor and controls to continue the state of increasing the number of rotations until the detected temperature comes in the aforesaid temperature range. When the detected temperature is lower than the temperature range, the number of rotations of the drive motor is reduced and the control means controls to continue the state of decreasing the number of rotations until the detected temperature comes in the aforesaid temperature range. Incidentally, the control means conducts the temperature control mentioned above for each low-pressure mercury lamp 14, and thereby, the metal cap 16 of the low-pressure mercury lamp 14 can maintain constantly about 55° C. in the course of image forming, which makes it possible to maintain stably the best state of luminous efficiency.

Next, operations of the ink jet recording apparatus 1 in the present embodiment will be explained.

After image recording operations are started, recording medium P is conveyed by the conveyance mechanism in the conveyance direction X, then, when it arrives at the prescribed position of platen 4, carriage 6 is reciprocated along guide rail 5, and necessary ink is jetted from ink jetting port 8 of recording head 7 based on prescribed image data. Simultaneously with this, low-pressure mercury lamps 14 of UV radiation apparatuses 12 are lit, and thereby, ink jetted on recording medium P is exposed to ultraviolet rays to be hardened and fixed, thus, an image is recorded on a recording surface of the recording medium P.

In this case, UV radiation is conducted under the condition that metal caps 16 of low-pressure mercury lamps 14 are kept by air cooling blower 31 of cooling device 30, in accordance with the control by the control means, to be within the temperature range of 55±5° C. Due to this, ink is hardened and fixed under the condition of the best luminous efficiency.

After completion of image forming on the recording medium, each recording head 7 is conveyed to one end portion of guide rail 5 by driven carriage 6, and maintenance is conducted by maintenance unit 20, thus, a series of operations are completed.

In the ink jet recording apparatus 1, as stated above, the control means controls cooling device 30 based on the detected temperature of metal cap 16 of each low-pressure mercury lamp 14, and therefore, even when using low-pressure mercury lamp 14 whose luminous efficiency tends to be lowered by temperature changes, it is possible to maintain the luminous efficiency to be a high efficiency, and to attain stable ink hardening and stabilization of image quality.

By using low-pressure mercury lamp 14 of a type of low power and low output as the light source for ultraviolet rays for hardening ink, it is possible to provide light source cover 13, avoiding the state of high temperature, and further to prevent more ultraviolet rays than needed from leaking out by the light source cover 13 and thereby to control an influence that is harmful the outside.

Further, the inside of the light source cover 13 is ventilated by the cooling device 30, and its exhaustion is conducted upward, thus, it is possible to stabilize image quality, avoiding an influence of exhaustion of cooling air in image forming.

Though the control means of the ink jet recording apparatus takes a method of control wherein a temperature of metal cap 16 of each low-pressure mercury lamp 14 is detected directly, and this is maintained by controlling the output of the cooling device 30, it is also possible to employ other methods provided that the temperature of the metal cap 16 can be maintained within the aforesaid range.

Figure 5:
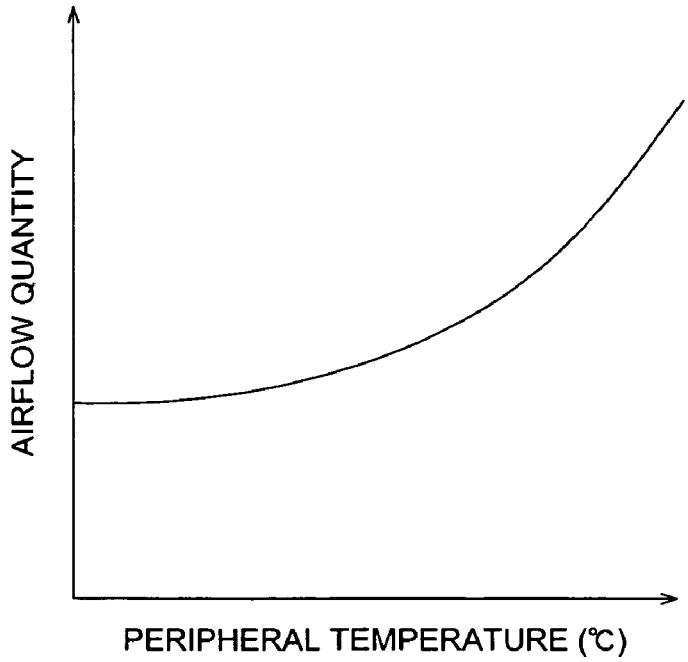
FIG. 5 is a diagram showing relationship between a temperature of the open air for maintaining the temperature at metal cap to be within a range of 55±5° C. and an output of a drive means of a air cooling blower.

For example, if the temperature of the open air to be taken in and air flow are determined, a quantity of heat to be cooled is determined. Therefore, it is also possible to employ the structure wherein the relationship shown in FIG. 5 between the temperature of the open air for maintaining a temperature of metal cap 16 within a range of 55±5° C. and the output of the drive means for the air cooling blower 31 is obtained in advance by tests, and this is stored in a non-volatile storage means such as a memory provided on the control means, then, a temperature sensor for detecting the temperature of the open air is provided in place of metal cap 16, and its detected temperature and the memory are referred to control an output of the drive means for the air cooling blower 31, thus the metal cap 16 can be kept at the prescribed temperature.

Incidentally, as a light source, any one of a black light, a cathode ray tube and LED may be used, without being limited to the low-pressure mercury lamp.

Further, air intake 13*b* and exhaust port 33 of the cooling device 30 may be reversed in terms of suction and exhaustion. In addition, though the exhaust port 33 is opened upward, the exhausted air may also be oriented or arranged not to hit recording medium P in the course of image forming and not to hit ink while it is jetted, without being limited to the exhaust port 33 facing upward.

Though a cooling fan is used as a means to control temperatures at a metal cap in the present embodiment, the means to control temperatures at a metal cap is not limited to the cooling fan.

For example, a Peltier module wherein Peltier elements representing plural thermoelectric cooling elements are connected in series electrically may be provided through a heat conducting section that is made of the material having high heat conductivity and covers a periphery of two metal caps 16. The Peltier module is arranged so that heat is absorbed through one side of Peltier elements and heat is radiated from the other side of Peltier elements when a DC current is sent to Peltier elements from a power supply section, and it is preferable that a cooling surface and a heating surface are switched each other by changing the direction of a current to be sent to Peltier elements. It is further preferable that a heat sink that radiates heat absorbed from the cooling surface and conducted while the contact surface of heat conducting section keeps to be a cooling surface, is provided on the surface facing the contact surface of the heat conducting section that comes in contact with a heat conducting section of the Peltier module, and that a cooling fan that radiates heat radiated from the heat sink is provided on the upper part of the heat sink.

It is preferable that the power supply section is controlled so that DC current is sent to the Peltier elements in the direction that makes the contact surface of the heat conducting section of the Peltier module to be the cooling surface when the temperature at the metal cap 16 is high, so that the temperature at the metal cap 16 may become the temperature at which the output is stabilized and the luminous efficiency becomes excellent, and it is preferable that the power supply section is controlled so that the cooling fan is driven to rotate, and DC current is sent to the Peltier elements in the direction which makes the contact surface of heat conducting section to be the heating surface, when the temperature at the metal cap 16 is low.

Though the cooling device 30 is of an air cooling type, it is also possible to provide a cooling device of a water cooling type such as a method to supply cooling water constantly by providing a water jacket or a water cooling tank that is in contact with all metal caps 16 of the light source, without being limited to the air cooling type one. In that case, temperature adjustment can be carried out by controlling the flow rate of cooling water.

It is also possible to employ the structure wherein a UV sensor 35 is provided as a light intensity detection means that detects light intensity of irradiation ultraviolet rays within a range of irradiation of each low-pressure mercury lamp 14, and the control means controls an output of a drive motor for air cooling blower 31 of the cooling device 30 based on the detected intensity of ultraviolet rays.

The UV sensor-mentioned above is composed, for example, of a filter transmitting only ultraviolet rays and a photoelectric conversion element that detects light intensity through the aforesaid filter.

Since the luminous efficiency of the low-pressure mercury lamp 14 is highly temperature-dependent as stated earlier, when the detected UV intensity is declined, occurrence of temperature changes especially on metal cap 16 of the low-pressure mercury lamp 14 can be considered. Therefore, when the detected UV intensity is declined, the control means controls to increase the number of rotations of the drive motor for the cooling device 30 under an assumption that temperature rise has happened.

Incidentally, in the low-pressure mercury lamp 14, a decline of UV intensity can happen even when the temperature of metal cap 16 is declined to be lower than about 55° C. It is therefore desirable not to drive the drive motor for the cooling device 30 for a period from the start of light emission of the low-pressure mercury lamp 14 to the moment when the UV intensity exceeds the peak, or to drive at small output to control to increase an output of the drive motor under the assumption that the temperature exceeded 55° C. under the state that UV intensity has declined after exceeding the peak. Further, sharp increase of the output of the drive motor leads to a possibility to supercool the metal cap 16 undesirably to be as low as 55° C. or less (not more than 55° C.–5° C.). It is therefore desirable that the number of rotations of the drive motor is established so that it is raised gradually at a small rate of increase so that the temperature of the metal cap 16 is constantly 55° C. or more, and it approaches 55° C. It is further preferable that an appropriate value for the rate of increase is obtained through tests.

What is claimed is:

1. An ink jet recording apparatus comprising:

(a) a recording head for jetting photo-hardening ink which is hardened when exposed to ultraviolet rays on a recording medium;

(b) a radiation apparatus having a light source for radiating the ultraviolet rays to jetted ink;

(c) a cooling device for cooling the radiation apparatus;

(d) a temperature detector for detecting a temperature of the radiation apparatus; and (e) a controller for controlling temperature of the cooling device on the basis of the temperature detected by the temperature detector, wherein the radiation apparatus comprises a cover for veiling the light source, the cooling device is an air cooling apparatus for supplying open air into the cover, and an exhaust port provided on the cover.

2. The ink jet recording apparatus of claim 1, wherein the temperature detector detects a temperature at a metal cap of the light source.

3. The ink jet recording apparatus of claim 2, wherein the controller controls the cooling device so that the detected temperatuie at the metal cap of the light source is within a range of 35° C. to 65° C.

4. The ink jet recording apparatus of claim 3, wherein the controller controls the cooling device so that the metal cap is at a temperature that makes radiation intensity for the ultraviolet rays to be at maximum with a tolerance of ±5° C.

5. The ink jet recording apparatus of claim 1, wherein the exhaust port is formed to be open in a direction other than a direction in which the recording head faces a recording medium on which the recording head jets ink.

6. The ink jet recording apparatus of claim 1, wherein the light source is any one of a low-pressure mercury lamp, a black light, a cold-cathode tube and LED.

7. The ink jet recording apparatus of claim 1, wherein the ink is cationpolymerization-based ink containing a cation-polymerization-based compound.

8. An ink jet recording apparatus comprising:

(a) a recording head for jetting photo-hardening ink which is hardened when exposed to ultraviolet rays on a recording medium;

(b) a radiation apparatus having a light source for radiating ultraviolet rays to jetted ink;

(c) a cooling device for cooling the radiation apparatus by supplying open air;

(d) a temperature detector for detecting a temperature of the open air; and (e) a controller for storing information about relationship between the open air temperature and an output of the cooling device for maintaining a temperature of the light source to be a prescribed temperature, and controlling a temperature of the cooling device on the basis of the temperature detected by the temperature detector, by referring to the information.

9. The ink jet recording apparatus of claim 8, wherein the Cemperature detector detects a temperature at a metal cap of the light source.

10. The ink jet recording apparatus of claim 9, wherein the controller controls the cooling device so that the detected temperature at the metal cap of the light source is within a range of 35° C. to 65° C.

11. The ink jet recording apparatus of claim 10, wherein the controller controls the cooling device so that the metal cap is at a temperature that makes radiation intensity for the ultraviolet rays to be at maximum with a tolerance of ±5° C.

12. The ink jet recording apparatus of claim 8, wherein the radiation apparatus comprises a cover for veiling the light source, the cooling device is an air cooling apparatus for supplying open air into the cover, and an exhaust port provided on the cover.

13. The ink jet recording apparatus of claim 12, wherein the exhaust port is formed to be open in a direction other than a direction in which the recording head faces a recording medium on which the recording head jets ink.

14. The ink jet recording apparatus of claim 8, wherein the light source is any one of a low-pressure mercury lamp, a black light, a cold-cathode tube and LED.

15. The ink jet recording apparatus of claim 8, wherein the ink is cation-polymerization-based ink containing a cation-polymerization-based compound.

* * * * *